US008495930B2

(12) United States Patent
Haughom

(10) Patent No.: US 8,495,930 B2
(45) Date of Patent: Jul. 30, 2013

(54) POWER TONG DEVICE

(75) Inventor: Per Olav Haughom, Tonstad (NO)

(73) Assignee: Seabed Rig AS (NO)

( * ) Notice: Subject to any disclaimer, the term of this patent is extended or adjusted under 35 U.S.C. 154(b) by 50 days.

(21) Appl. No.: 13/124,160

(22) PCT Filed: Oct. 12, 2009

(86) PCT No.: PCT/NO2009/000354

§ 371 (c)(1),
(2), (4) Date: May 26, 2011

(87) PCT Pub. No.: WO2010/044673

PCT Pub. Date: Apr. 22, 2010

(65) Prior Publication Data

US 2011/0219916 A1 Sep. 15, 2011

(30) Foreign Application Priority Data

Oct. 14, 2008 (NO) ..... 20084287

(51) Int. Cl.
*B25B 13/50* (2006.01)
*E21B 19/16* (2006.01)

(52) U.S. Cl.
USPC ..... 81/57.16; 81/57.34

(58) Field of Classification Search
USPC ..... 81/57.16, 57.34, 57.24, 57.35, 57.36, 81/57.4
See application file for complete search history.

(56) References Cited

U.S. PATENT DOCUMENTS

| | | | | |
|---|---|---|---|---|
| 5,099,725 | A * | 3/1992 | Bouligny et al. | 81/57.34 |
| 5,259,275 | A | 11/1993 | Schulze-Beckinghausen | |
| 5,390,568 | A | 2/1995 | Pietras | |
| 7,891,418 | B2 * | 2/2011 | Begnaud et al. | 81/57.34 |
| 7,921,750 | B2 * | 4/2011 | Pietras | 81/57.16 |
| 2005/0160880 | A1 | 7/2005 | Schulze-Beckinghausen et al. | |

FOREIGN PATENT DOCUMENTS

WO 98/32948 A1 7/1998

* cited by examiner

*Primary Examiner* — Hadi Shakeri
(74) *Attorney, Agent, or Firm* — Akerman Senterfitt

(57) ABSTRACT

A power tong device (1) for handling of a threaded pipe connection wherein the power tong device (1) comprises a frame (6) having a power tong (10) and a holding tong (8) and also a drive gear (12) for the power tong (10), and wherein the power tong (10) is displaceable relative to the holding tong (8) along its rotational axis, as the power tong (10) is radially displaceable relative to the holding tong (8), and wherein the power tong (10) is connected to the drive gear (12) by means of a radially displaceable coupling (26, 54).

5 Claims, 3 Drawing Sheets

III–III

POWER TONG DEVICE

This application is a national phase of PCT/NO2009/000354, filed Oct. 12, 2009, and claims priority to NO 20084287, filed Oct. 14, 2008, the entire contents of both of which are hereby incorporated by reference.

BACKGROUND OF THE INVENTION

This invention relates to a power tong device. More particularly it concerns a power tong device comprising a frame with a power tong and a holding tong and also a drive gear for the power tong, and wherein the power tong relative to the holding tong is displaceable along its rotational axis.

Known power tong devices for use such as on a drill floor, comprises a driven power tong and a holding tong working about a common rotational axis, as the central axis also constitutes the power tong rotational axis.

When a pipe joint shall be connected to a pipe string, it is common to hold the upper pipe string socket fixedly in the holding tong. The pipe joint pin is displaced down toward the socket where the pipe joint is gripped by the power tong. The power tong together with the pipe joint is displaced in a direction toward the socket while the power tong rotates the pipe joint about its rotational axis.

The pin joint threads thereby enter the socket threads and are screwed into these with the desired torque.

Experience shows that a threading operation of this kind may damage the thread if the pipe joint is not concentric with the rotational axis when the pin joint threads enter the socket.

The reason is thought to be that when the power tong positions the pipe joint centrally by its grip on the pipe joint, an angular deviation between the pipe joint and the rotational axis may entail that so large strains are inflicted on the threads, that they are damaged.

Thread damage may cause the pipe string to have to be pulled sufficiently up to change out the damaged pipe joint, causing both extra work and unnecessary cost.

SUMMARY OF THE INVENTION

The object of the invention is to remedy or reduce at least one of the prior art drawbacks.

The object is achieved according to the invention by the features stated in the below description and in the following claims.

There is provided a power tong device wherein the power tong device comprises a frame with a power tong and a holding tong and also a drive gear for the power tong, and wherein the power tong, relative to the holding tong is displaceable along its rotational axis. The power tong device is characterised in that the power tong is radially displaceable relative to the holding tong.

The power tong thus allows that the joint pin threads seek into a position where they may enter the socket and where they to an insignificant degree are exposed to radial forces from the power tong.

The power tong may be connected to the drive gear by means of a radially displaceable coupling. Thus the drive gear in a per se known way may have a fixed rotational axis within the frame, simplifying transmission of such as pressurised fluid to drive motors.

The coupling may be constituted of such as a universal coupling or a curved gear coupling. Couplings of this kind are of relatively simple design and can at the same time transfer a considerable torque even with modest dimensions.

The coupling may be axially displaceable relative to the drive gear. The coupling may thereby follow the power tong axial displacement, while the drive gear may be stationary in the frame.

Hydraulic fluid to the power tong grippers may for example be transferred via a swivel coupling connected to the drive gear.

A device according to the invention facilitates a gentle operation of entering and screwing together of the coupling pin thread and the socket thread during connection of a pipe joint to a pipe string, relative to prior art.

BRIEF DESCRIPTION OF THE DRAWINGS

In the following is described an example of a preferred embodiment being illustrated in the accompanying drawings, wherein.

DETAILED DESCRIPTION

Figure 1:
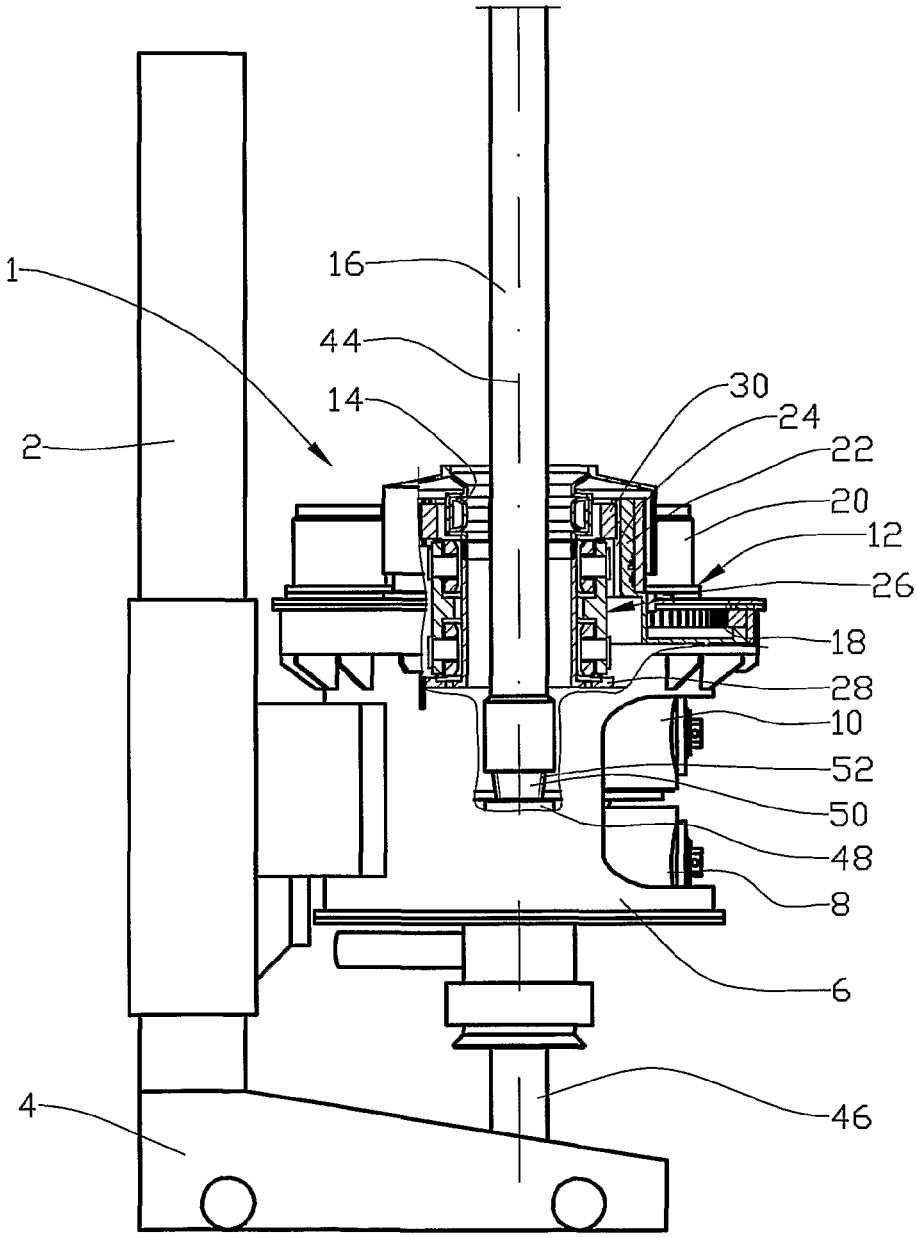
FIG. 1 shows in part section a power tong device according to the invention.

In the drawings the reference numeral 1 indicates a power tong device, which in a per se known way is vertically displaceably connected to a vertical guide 2 constituting part of a carriage 4 on a not shown drill floor.

The power tong device 1 comprises a housing-like frame 6 where is provided a fixed holding tong 8, a driven power tong 10 and a drive gear 12 for the power tong 10.

In this preferred exemplary embodiment the frame 6 also comprises a sealing coupling 14 provided to be able to grip and seal about a pipe joint 16 during connection operations.

The drive gear 12 comprises an in the frame 6 supported gear ring 18 which is driven by at least one hydraulic motor 20. The gear ring 18 is connected to a drive ring 22 positioned at a distance above the power tong 10. The drive ring 22 is provided with internal axial grooves 24.

A universal coupling 26, which by means of a flange ring 28 is connected to the power tong 10, extends up to the drive ring 22. A sheave ring 30 constituting the upper portion of the universal coupling 26, is provided with radially outward extending sheaves 32, see FIG. 2, complementary fitting in the grooves 24 in the drive ring 22. The section shown in FIG. 1 of the universal coupling 26 corresponds to section IIa-IIa of FIG. 2.

Figure 2:
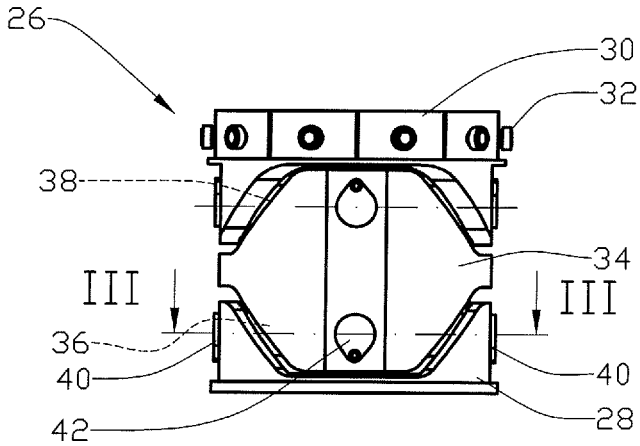
FIG. 2 shows in greater detail a side view of a universal coupling.
Figure 3:
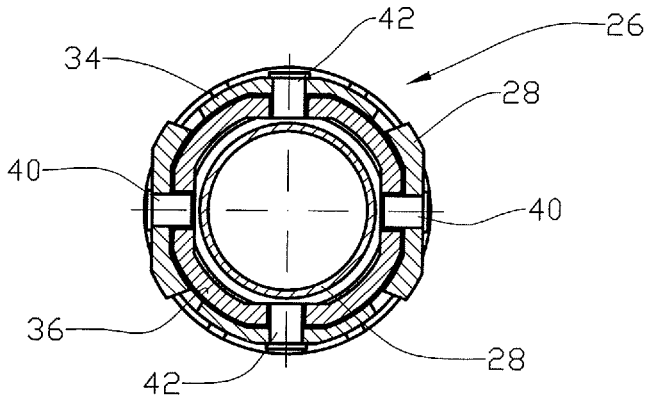
FIG. 3 shows a section III-III of FIG. 2.
Figure 4:
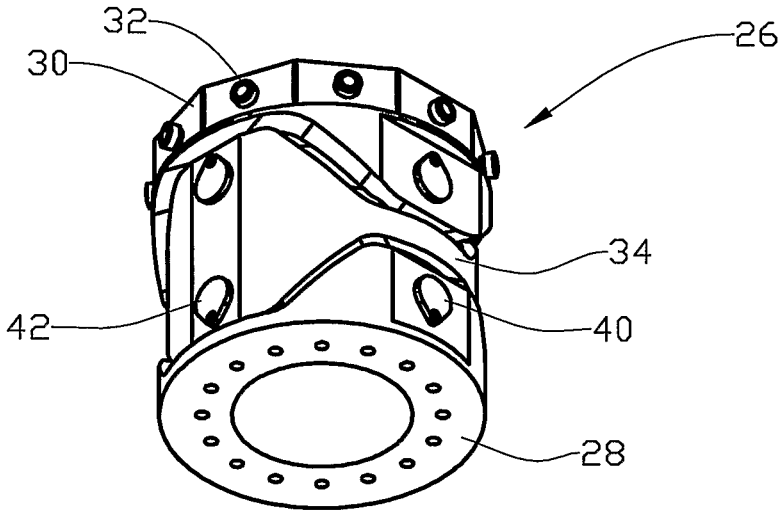
FIG. 4 shows the universal coupling of FIG. 2 in perspective.

The universal coupling 26 also comprises an intermediate sleeve 34; see FIG. 2, a lower link ring 36 and an upper link ring 38. The lower link ring 36 is linkably connected to the flange ring 28 by means of a first link bolt pair 40, and to the intermediate sleeve 34 by means of a second link bolt pair 42. The first link bolt pair 40 is at right angles to the second link bolt pair 42.

The upper link ring 38 is in a corresponding way connected to the intermediate sleeve 34 and to the sheave ring 30.

In an unloaded condition the holding tong 8, the power tong 10, the gear ring 18, the drive ring 22 and the universal coupling 26 have a common central axis 44.

During make up of the pipe joint 16 to a pipe string 46 upper socket 48, the upper socket 48 is held fixedly by the holding tong 8. The pipe joint 16 is lowered and gripped by the power tong 10, see FIG. 1. The drive gear rotates by means of the universal coupling 26, the power tong and thereby the pipe joint 16 about its central axis 44. At the same time the power tong 10 and the pipe joint 16 are in a per se known manner displaced by means of not shown hydraulics, in a direction toward the upper socket 48, as the sheaves 32 are displaced in the grooves 24.

If the pipe joint 16 has a direction that does not coincide with the central axis 44, the power tong 10 will, if the pipe joint 16 connector pin 50 does not hit the upper socket 48 concentrically due to the manner of operation of the universal coupling 26, be able to be displaced radially. This entails that the connector pin 50 thread 52 and the upper socket 48 not shown thread are only inflicted insignificantly radial forces during the entering and screwing operation.

Figure 5:
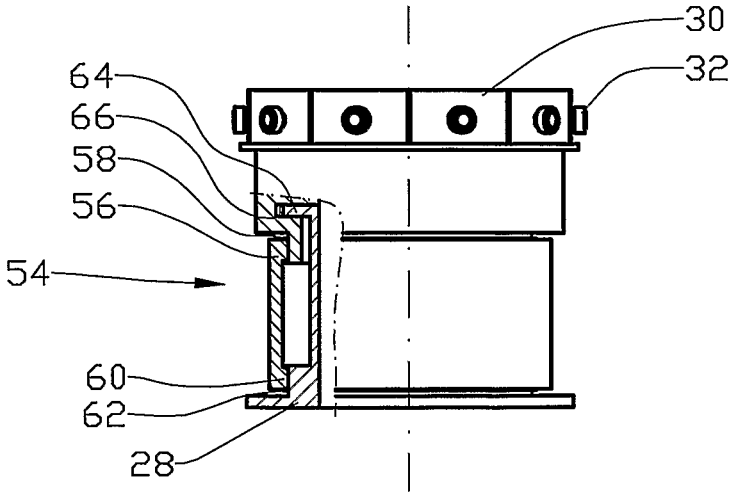
FIG. 5 shows a curved gear coupling partly in section.

In an alternative embodiment, see FIG. 5, the flange ring 28 is connected to the sheave ring 30 by means of a curved gear coupling 54.

The curved gear coupling 54 upper set of teeth 56 cooperates with an external cogging 58 in the sheave ring 30. The lower set of teeth 60 of the curved gear coupling 54 cooperates with an external cogging 62 in the flange ring 28. The flange ring 28 is provided with a radially extending slide ring 64 at its upper portion, as the slide ring 64 fits complementary and displaceably in a groove 66 in the sheave ring 30. Axial forces between the sheave ring 30 and the flange ring 28 are taken up in the abutment surfaces between the slide ring 64 and the groove 66. The flange ring 28 is radially displaceable relative to the sheave ring 30, as the torque is transmitted by means of the curved gear coupling 54.

The invention claimed is:

1. A power tong device for handling of a threaded pipe connection, wherein the power tong device comprises:

a frame having a power tong, a holding tong, and a drive gear for the power tong, wherein the power tong is radially displaceable relative to the holding tong, wherein the power tong is connected to the drive gear by means of a coupling that is radially displaceable relative to the drive gear, and wherein the coupling is connected to the power tong via a flange ring, and extends up to a drive ring of the drive gear.

2. The power tong device according to claim 1, wherein the coupling is constituted by a universal coupling.

3. The power tong device according to claim 1, wherein the coupling is constituted by a curved gear coupling.

4. The power tong device according to claim 1, wherein the coupling is also axially displaceable relative to the drive gear.

5. The power tong device according to claim 1, wherein the drive gear has a fixed rotational axis within the frame.

* * * * *